US011365610B2

(12) United States Patent
McChesney et al.

(10) Patent No.: US 11,365,610 B2
(45) Date of Patent: Jun. 21, 2022

(54) HYDRAULIC SCREEN WITH FLOW CONTROL DEVICE MODULE

(71) Applicant: Halliburton Energy Services, Inc., Houston, TX (US)

(72) Inventors: Ryan Wesley McChesney, Prosper, TX (US); Gordon McLeary, Dallas, TX (US); David Symon Grant, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 60 days.

(21) Appl. No.: 16/933,592

(22) Filed: Jul. 20, 2020

(65) Prior Publication Data

US 2022/0018222 A1 Jan. 20, 2022

(51) Int. Cl.
*E21B 43/08* (2006.01)

(52) U.S. Cl.
CPC ..... *E21B 43/08* (2013.01)

(58) Field of Classification Search
CPC ..... E21B 43/08–108
See application file for complete search history.

(56) References Cited

U.S. PATENT DOCUMENTS 5,868,200 A * 2/1999 Bryant ..... E21B 43/08 166/51
7,938,184 B2 * 5/2011 Yeh ..... E21B 43/04 166/278
8,602,110 B2 12/2013 Kuo et al.
8,925,633 B2 1/2015 Nguyen
9,027,637 B2 5/2015 Kang et al.
9,638,013 B2 * 5/2017 Yeh ..... E21B 43/08
9,725,985 B2 8/2017 McNamee et al.
10,041,338 B2 8/2018 Least
2012/0006563 A1 1/2012 Patel et al.
2013/0220606 A1 * 8/2013 Yhuel ..... E21B 43/04 166/278
2014/0262322 A1 * 9/2014 Yeh ..... E21B 43/08 166/373
2015/0027726 A1 * 1/2015 Bruce ..... E21B 43/086 166/373

(Continued)

FOREIGN PATENT DOCUMENTS

CA 2938715 A1 2/2017
WO 2018190819 A1 10/2018

*Primary Examiner* — Steven A MacDonald
(74) *Attorney, Agent, or Firm* — Scott Richardson; Parker Justiss, P.C.

(57) ABSTRACT

Disclosed herein are embodiments of a flow control device (FCD) module for use with hydraulic screens. In one embodiment, the FCD module comprises a base pipe having a port coupling an exterior of the base pipe and an interior of the base pipe; an FCD unit coupled to the base pipe about the port and configured to control production fluid from an oil and gas formation to the interior of the base pipe; one or more separate isolated activation channels extending along at least a portion of the base pipe, the one or more separate isolated activation channels configured to fluidly couple with one or more hydraulic activation chambers of a screen subassembly; and one or more covers surrounding the base pipe about the FCD unit, the one or more covers forming a production fluid channel between the screen subassembly and the FCD unit.

17 Claims, 5 Drawing Sheets

(56) References Cited

U.S. PATENT DOCUMENTS

| | | | | |
|---|---|---|---|---|
| 2015/0053419 | A1 | 2/2015 | Garcia et al. | |
| 2015/0068770 | A1 | 3/2015 | Metcalfe | |
| 2016/0040515 | A1 | 2/2016 | Yeh et al. | |
| 2016/0326849 | A1* | 11/2016 | Bruce | E21B 43/084 |
| 2018/0081468 | A1 | 3/2018 | Bruce et al. | |

* cited by examiner

HYDRAULIC SCREEN WITH FLOW CONTROL DEVICE MODULE

BACKGROUND

Flow control devices (FCDs), which include inflow control devices (ICDs) and autonomous inflow control devices (AICDs), may be positioned in a completion string of a wellbore to balance or control fluid inflow along the length of the wellbore. Sand control screens are used downhole in production assemblies for collecting production fluids while preventing the mobilization of problematic sand and particulates from a wellbore into production piping. Some sand control screens may be are hydraulically activated by means of chambers, which may be activated from pressure or fluids applied from the surface.

BRIEF DESCRIPTION

Reference is now made to the following descriptions taken in conjunction with the accompanying drawings, in which.

DETAILED DESCRIPTION

Figure 1:
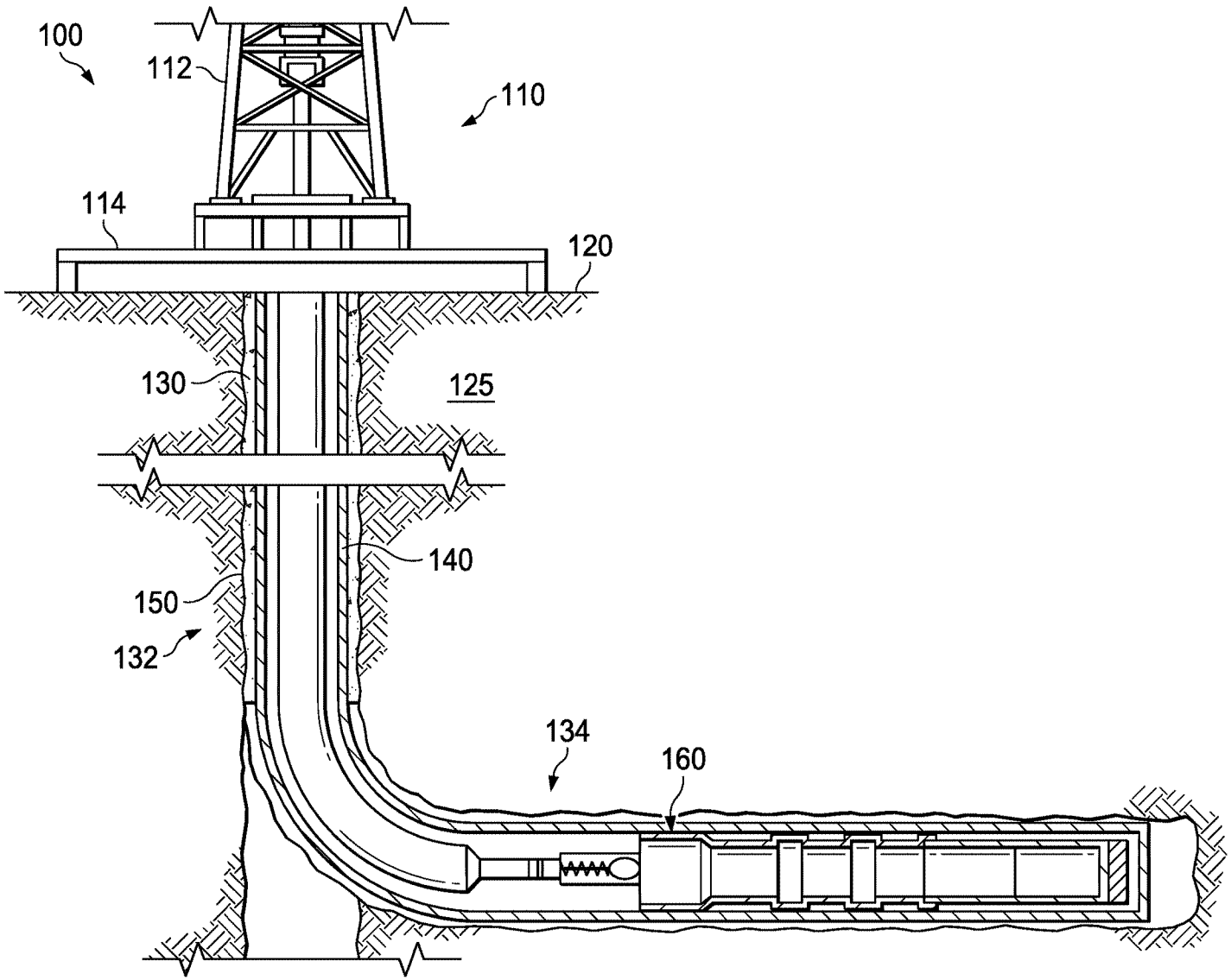
FIG. 1 illustrates a well system including an exemplary operating environment that the apparatuses, systems and methods disclosed herein may be employed.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Furthermore, unless otherwise specified, use of the terms "up," "upper," "upward," "uphole," "upstream," or other like terms shall be construed as generally toward the surface of the formation; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Additionally, unless otherwise specified, use of the term "subterranean formation" shall be construed as encompassing both areas below exposed earth and areas below earth covered by water such as ocean or fresh water.

FIG. 1 illustrates a well system 100 including an exemplary operating environment that the apparatuses, systems and methods disclosed herein may be employed. Unless otherwise stated, the horizontal, vertical, or deviated nature of any figure is not to be construed as limiting the wellbore to any particular configuration. As depicted, the well system 100 may suitably comprise a rig 110 positioned on the earth's surface 120, or alternatively moored to a sea floor in a body of water, and extending over and around a wellbore 130 penetrating a subterranean formation 125 for the purpose of recovering hydrocarbons and the like. The wellbore 130 may be drilled into the subterranean formation 125 using any suitable drilling technique. In one embodiment, the rig 110 comprises a derrick 112 with a rig floor 114. The rig 110 may be conventional and may comprise a motor driven winch and/or other associated equipment for extending a work string, a casing string, or both into the wellbore 130.

In one embodiment, the wellbore 130 may extend substantially vertically away from the earth's surface 120 over a vertical wellbore portion 132, or may deviate at any angle from the earth's surface 120 over a deviated wellbore portion 134. In this embodiment, the wellbore 130 may comprise one or more deviated wellbore portions 134. In alternative operating environments, portions or substantially all of the wellbore 130 may be vertical, deviated, horizontal, and/or curved. The wellbore 130, in this embodiment, includes a casing string 140. In the embodiment of FIG. 1, the casing string 140 is secured into position in the subterranean formation 125 in a conventional manner using cement 150.

The well system 100 of the embodiment of FIG. 1 further includes a sand control screen assembly 160 designed, manufactured and operated according to the disclosure. In accordance with one embodiment, the sand control screen assembly 160 includes a flow control device (FCD) module and a screen subassembly manufactured in accordance with the disclosure. The FCD module, in some embodiments, may include at least a base pipe having a port coupling an exterior of the base pipe and an interior of the base pipe, and an FCD unit coupled to the base pipe about the port and configured to control production fluid from an oil and gas formation to the interior of the base pipe. The FCD module may additionally include one or more separate isolated activation channels extending along at least a portion of the base pipe. The one or more separate isolated activation channels may be configured to fluidly couple with one or more hydraulic activation chambers of the screen subassembly. The FCD module may also include one or more covers surrounding the base pipe and positioned about the FCD unit, the one or more covers forming a production fluid channel between the screen subassembly and the FCD unit.

The screen subassembly, in one embodiment, may include one or more hydraulic screens coupled together in series. Each of the one or more hydraulic screens may include a blank pipe section; one or more hydraulic activation chambers disposed exteriorly of the blank pipe section; and a filter medium disposed about the one or more hydraulic activation chambers for receiving production fluid from an oil and gas formation.

Once the sand control screen assembly 160 reaches a desired position within the wellbore, fluid or pressure may be applied through the one or more separate isolated activation channels into the one or more hydraulic activation channels, activating the screen subassembly radially outward toward the wellbore 130. The production fluids may then be collected and transferred to the FCD unit via the production fluid channels between the screen subassembly and the FCD unit, and thereafter transported to the surface through the base pipe.

While the well system 100 depicted in FIG. 1 illustrates a stationary rig 110, one of ordinary skill in the art will readily appreciate that mobile workover rigs, wellbore servicing units (e.g., coiled tubing units), and the like may be similarly employed. Further, while the well system 100 depicted in FIG. 1 refers to a wellbore 130 penetrating the earth's surface on dry land, it should be understood that one or more of the apparatuses, systems and methods illustrated herein may alternatively be employed in other operational environments, such as within an offshore wellbore operational environment for example, a wellbore 130 penetrating subterranean formation beneath a body of water.

Figure 2:
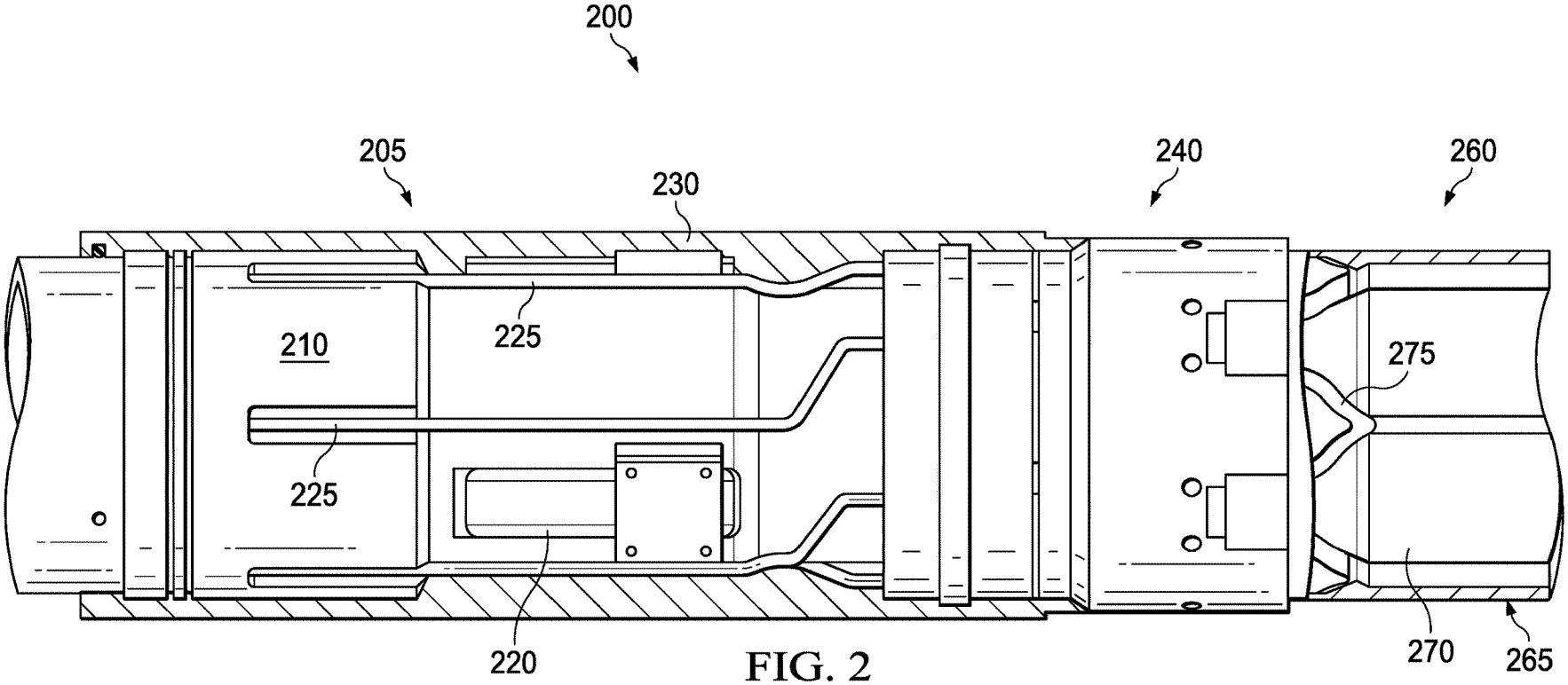
FIG. 2 illustrates one embodiment of a sand control screen assembly according to the disclosure as may be used with the well system of FIG. 1.

FIG. 2 illustrates one embodiment of a sand control screen assembly 200 as may be used with the well system 100 of FIG. 1. In one embodiment, the sand control screen assembly 200 includes a flow control device (FCD) module 205 and a screen subassembly 260. In some embodiments, the FCD module 205 may be an inflow control device (ICD) or in other embodiments, may be an autonomous inflow control module (AICD). The FCD module 205, in some embodiments, may include at least a base pipe 210 having at least one port (not shown) coupling an exterior of the base pipe 210 and an interior of the base pipe 210. The FCD module 205 may additionally include at least one FCD unit 220 coupled to the base pipe 210 about the port. The FCD unit 220, in one example embodiment, is configured to control production fluid from an oil and gas formation to the interior of the base pipe 210. While only a single FCD unit 220 is illustrated in FIG. 2, other embodiments may exist wherein more than one FCD unit 220 is employed. For example, another embodiment employs a second FCD unit downhole of the screen subassembly 260.

The FCD module 205, in some embodiments, may have one or more separate isolated activation channels 225 extending along at least a portion of the base pipe 210. In some embodiments, the FCD module may have additional activation channels, such as two or more. The activation channels 225 may be configured to fluidly couple an activation fluid source with the screen subassembly 260. In other embodiments, the activation channels 225 may be coupled with other tools and devices. In certain embodiments, the activation channels 225 may be control lines or formed tubing extending along at least a portion of the base pipe 210, and may be disposed exteriorly around the base pipe 210, and in other embodiments, may be integrally formed within the base pipe 210.

One or more covers 230 may surround at least a portion of the base pipe 210 and the FCD unit 220. The one or more covers 230 may form a production fluid channel between the screen subassembly 260 and the FCD unit 220. In some embodiments, the one or more covers 230 may be removable such that the FCD unit 220 may be accessed, adjusted and modified prior to inserting the sand control screen assembly 200 into the wellbore. And in some embodiments, the activation channels 225 may be positioned between the base pipe 210 and the one more covers 230 surrounding the base pipe 210. Accordingly, the fluid within the activation channels 225 will remain separate from any fluid in the production fluid channel.

The screen subassembly 260, in one embodiment, may include one or more hydraulic screens 265 connected in series. While only the top most hydraulic screen 265 is shown in FIG. 2, other embodiments may exist wherein one or more hydraulic screens are coupled together. In one embodiment, each of the hydraulic screens 265 may include one or more hydraulic activation chambers 270. The hydraulic activation chambers 270, in one embodiment, are bladders. In the embodiment of FIG. 2, the one or more hydraulic activation chambers 270, and more specifically the space there between, define one or more production fluid channels 275 for collecting production fluid from the subterranean formation. While not illustrated in the view of FIG. 2, a filter medium would be positioned about the one or more hydraulic activation chambers 270. In operation, activation fluid would enter the hydraulic activation chambers 270, thereby biasing them radially outward, and in turn urging the filter medium against the subterranean formation. Accordingly, production fluid from the subterranean formation would be allowed to flow through the filter medium and collected by the production fluid channels 275 for sending uphole through the FCD module 205.

In some embodiments, the sand control screen assembly 200 may include a ring, such as diverter ring 240 coupled between the FCD module 205 and the screen subassembly 260. In one embodiment, the diverter ring 240 is coupled about the base pipe 210. Accordingly, the diverter ring may 240 be configured to physically and fluidly couple the FCD module 205 with the screen subassembly 260. In some embodiments, the diverter ring 240 may physically couple with the FCD module 205, in some embodiments, via a threaded connection. In other embodiments, the diverter ring 240 may slide onto the FCD module 205 and include a seal, and in some embodiments, may be welded with the FCD module 205 or other connection methods. The diverter ring 240 may include corresponding ring hydraulic activation channels (not shown in the view of FIG. 2), which fluidly couple the activation channels 225 of the FCD module 205 and the hydraulic activation chambers 270 of the screen subassembly 260. The diverter ring 240 may also include corresponding ring production fluid channels (not shown in the view of FIG. 2), which fluidly couple the production fluid channels 275 of the screen subassembly with the production fluid channel of the FCD module 205. (An embodiment of a diverter ring will be shown and described in more detail herein with regard to FIG. 5).

In certain embodiments, the diverter ring 240 is not only employed to physically and fluidly couple the FCD module 205 with the screen subassembly 260, but additional diverter rings 240 are employed to physically and fluidly couple the various different hydraulic screens 265 that are coupled in series. In certain embodiments, these additional diverter rings 240 are similar, if not identical to, the diverter ring 240 shown in FIG. 2.

Figure 3:
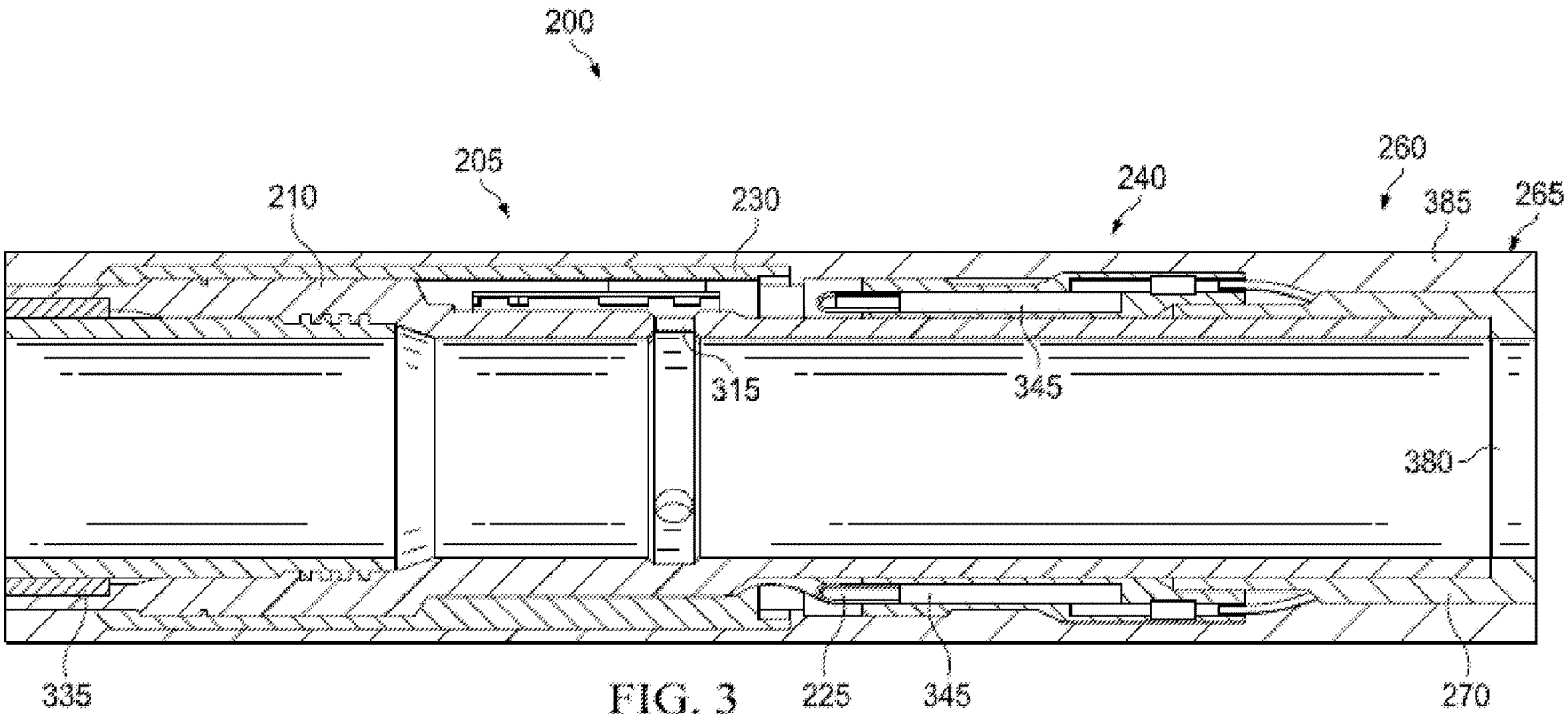
FIG. 3 illustrates a cross-sectional view of the sand control screen assembly of FIG. 2.

FIG. 3 illustrates a cross-sectional view of the sand control screen assembly 200 of FIG. 2. The FCD module 205, diverter ring 240, and the screen subassembly 260 are visible in the view of FIG. 3. The view of FIG. 3 more readily illustrates the at least one port 315 coupling an exterior of the base pipe 210 and an interior of the base pipe 210 in the FCD module 205. The view of FIG. 3 also more readily illustrates the ring hydraulic activation channels 345 in the diverter ring 240. As is illustrated, the ring hydraulic activation channels 345 in the diverter ring 240 couple the activation channels 225 and the hydraulic activation chambers 270.

The view of FIG. 3 also more readily illustrates that the hydraulic screens 265 may include a blank pipe section 380. As shown, the one or more hydraulic activation chambers 270 are disposed exteriorly of the blank pipe section 380. Furthermore, the view of FIG. 3 also more readily illustrates the filter medium 385. As is shown, the filter medium 385 may be disposed about the hydraulic activation chambers 270 for receiving production fluid from an oil and gas formation within the wellbore. In some embodiments, a control line or formed tubing, such as a hydraulic source line 335 may extend along at least a portion of the base pipe 210 and may be couple with the FCD module 205 for providing hydraulic fluid from the surface.

Figure 4:
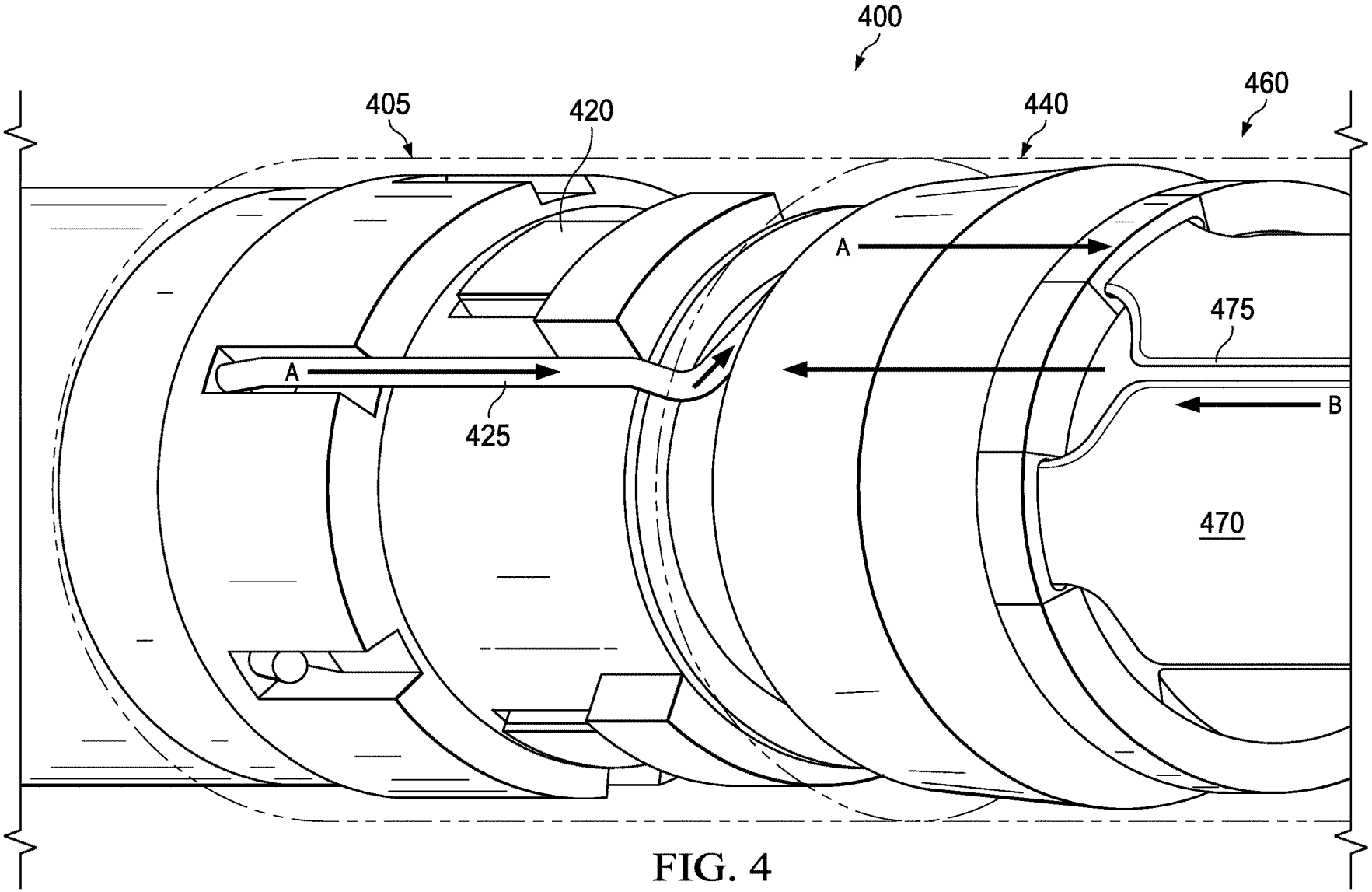
FIG. 4 illustrates an alternative embodiment of a sand control screen assembly designed, manufactured and operated according to the disclosure.

FIG. 4 illustrates an alternative embodiment of a sand control screen assembly 400 designed, manufactured and operated according to the disclosure. The sand control screen assembly 400 is similar in many respects to the sand control screen assembly 200 illustrated in FIGS. 2 and 3. FIG. 4 illustrates the flow paths of fluids between an FCD module 405 and a screen subassembly 460. Flow path A illustrates the general flow of hydraulic activation fluid, whereas flow path B illustrates the general flow of production fluid. Flow path A and B are separate and isolated through separate channels as will be shown in FIG. 5. As shown in flow path A, hydraulic activation fluid travels from the FCD module 405 through one or more separate isolated activation channels 425, in some embodiments, through ring hydraulic activation channels of diverter ring 440, and into hydraulic activation chambers 470 of the screen subassembly 460. At this stage, the hydraulic activation fluid would activate the hydraulic activation chambers 470 to urge the filter medium in contact with the formation.

As shown in flow path B, production fluid flows through the filter medium of the screen subassembly 460, into the production fluid channels 475, through the ring production fluid channels in the diverter ring 440, and into the production fluid channel of the FCD module 405, where it passes through the at least one FCD unit 420 and through a port beneath the FCD unit 420 into an interior of a base pipe (not shown) for transport to the surface of the well.

Figure 5:
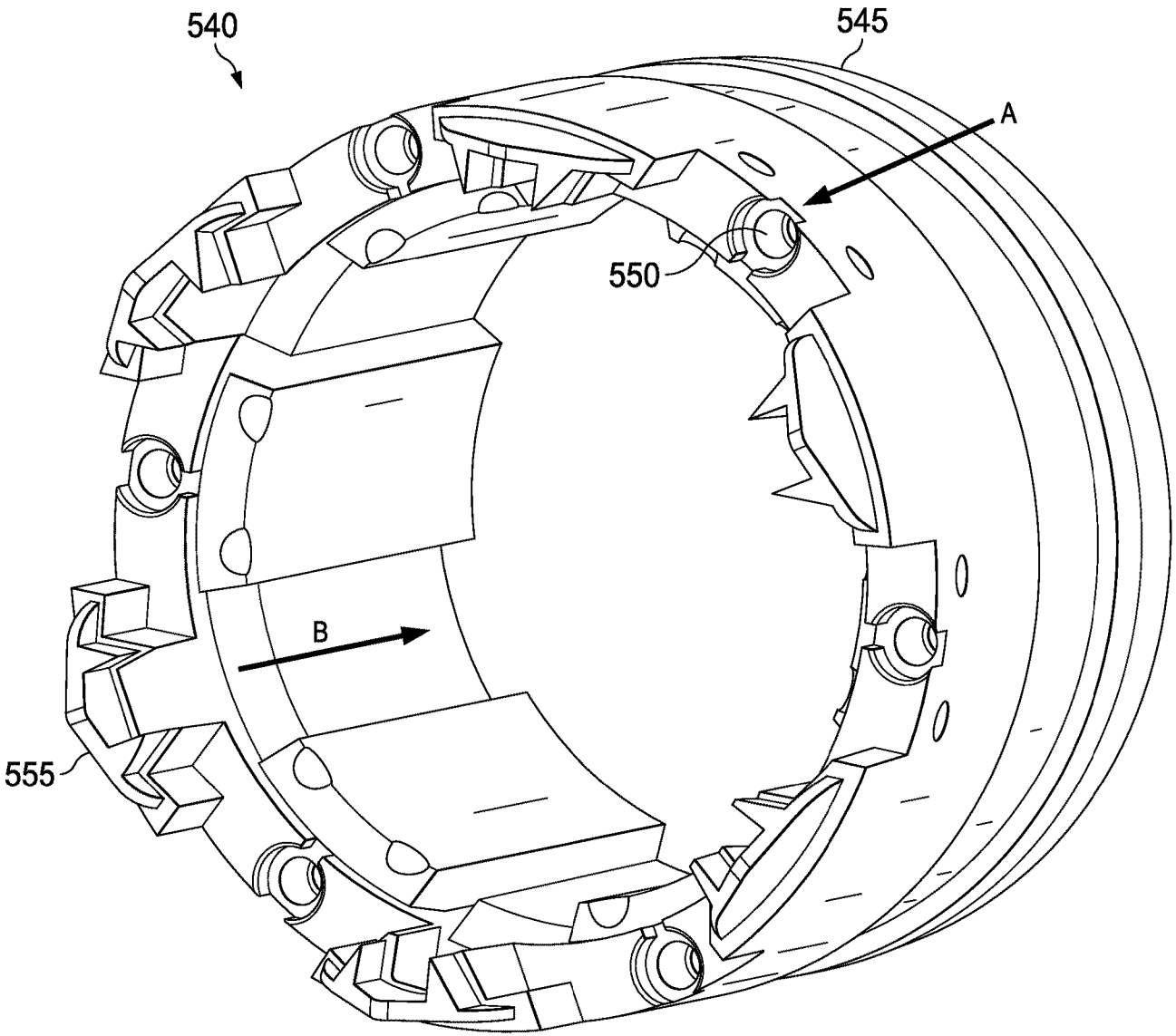
FIG. 5 illustrates one embodiment of a diverter ring which may be used with a sand control screen assembly according to the disclosure.

FIG. 5 illustrates one embodiment of a diverter ring 540, which may be used with a sand control screen assembly according to the disclosure, such as, e.g., the sand control screen assembly 200 shown in FIG. 2. The diverter ring 540 may include an annular ring 545 positioned about a portion of a base pipe, such as e.g., base pipe 210, and coupled between an FCD module and a screen subassembly. The annular ring 545 may include one or more ring hydraulic activation channels 555, which may fluidly couple between one or more separate isolated activation channels of the FCD module and hydraulic activation chambers of the screen subassembly, to deliver hydraulic fluid to the screen subassembly along flow path A. The annular ring 545 may also include one or more ring production fluid channels 550, which may fluidly couple between production channels of the screen subassembly and the FCD module, to transfer production fluids from the screen subassembly to the FCD module along flow path B. In some embodiments, the ring production channels 555 may be positioned between an inner radial surface of the diverter ring and the base pipe. The annular ring 545, in some embodiments, may comprise metals and may be cast using a mold.

Aspects Disclosed Herein Include:

A: A flow control device (FCD) module, comprising: a base pipe having a port coupling an exterior of the base pipe and an interior of the base pipe; an FCD unit coupled to the base pipe about the port and configured to control production fluid from an oil and gas formation to the interior of the base pipe; one or more separate isolated activation channels extending along at least a portion of the base pipe, the one or more separate isolated activation channels configured to fluidly couple with one or more hydraulic activation chambers of a screen subassembly; and one or more covers surrounding the base pipe and positioned about the FCD unit, the one or more covers forming a production fluid channel between the screen subassembly and the FCD unit.

B: A sand control screen assembly, comprising: a screen subassembly, including: a blank pipe section; one or more hydraulic activation chambers disposed exteriorly of the blank pipe section; and a filter medium disposed about the one or more hydraulic activation chambers for receiving production fluid from an oil and gas formation; and an FCD module fluidly coupled to the screen subassembly, the FCD module including; a base pipe having a port coupling an exterior of the base pipe and an interior of the base pipe; an FCD unit coupled to the base pipe about the port and configured to control production fluid from the oil and gas formation to the interior of the base pipe; one or more separate isolated activation channels extending along at least a portion of the base pipe, the one or more separate isolated activation channels fluidly coupled with the one or more hydraulic activation chambers of the screen subassembly; and one or more covers surrounding the base pipe and positioned about the FCD unit and forming a production fluid channel between the filter medium and the FCD unit.

C: A well system, comprising: a wellbore; production tubing extending from a surface of the wellbore; a sand control screen assembly coupled to the production tubing, the sand control screen assembly including: a blank pipe section; one or more hydraulic activation chambers disposed exteriorly of the blank pipe section; and a filter medium disposed about the one or more hydraulic activation chambers for receiving production fluid from an oil and gas formation; and an FCD module fluidly coupled to the screen assembly, the FCD module including; a base pipe having a port coupling an exterior of the base pipe and an interior of the base pipe; an FCD unit coupled to the base pipe about the port and configured to control production fluid from the oil and gas formation to the interior of the base pipe; one or more separate isolated activation channels extending along at least a portion of the base pipe, the one or more separate isolated activation channels fluidly coupled with the one or more hydraulic activation chambers; and one or more covers surrounding the base pipe and positioned about the FCD unit and forming a production fluid channel between the filter medium and the FCD unit.

Aspects A, B, and C may have one or more of the following additional elements in combination:

Element 1: wherein the one or more covers are removable;

Element 2: wherein the one or more separate isolated activation channels are positioned between the base pipe and the one more covers surrounding the base pipe;

Element 3: wherein the one or more separate isolated activation channels are disposed exteriorly about the base pipe;

Element 4: further including a diverter ring positioned about the base pipe, the diverter ring configured to physically and fluidly couple the FCD module to the screen subassembly;

Element 5: wherein the diverter ring includes one or more ring hydraulic activation channels which are configured to fluidly couple the one or more separate isolated activation channels and the one or more hydraulic activation chambers of the screen subassembly;

Element 6: wherein the diverter ring includes one or more ring production fluid channels which are configured to fluidly couple production fluid from the formation with the production fluid channel of the FCD module;

Element 7: wherein the one or more hydraulic activation chambers are bladders;

Element 8: wherein the diverter ring is coupled with the FCD module by a threaded connection;

Element 9: further comprising a diverter ring coupled between the FCD unit and the screen subassembly, wherein the diverter ring includes: one or more ring hydraulic activation channels which fluidly couple the one or more separate isolated activation channels and the one or more hydraulic activation chambers; and one or more ring production fluid channels which fluidly couple production fluid from the formation with the production fluid channel of the FCD module.

Further additions, deletions, substitutions and modifications may be made to the described embodiments.

What is claimed is:

1. A flow control device (FCD) module, comprising:

a base pipe having a port coupling an exterior of the base pipe and an interior of the base pipe;

an FCD unit coupled to the base pipe about the port and configured to control production fluid from an oil and gas formation to the interior of the base pipe;

one or more separate isolated activation channels extending along at least a portion of the base pipe, the one or more separate isolated activation channels configured to fluidly couple with one or more hydraulic activation chambers of a screen subassembly; and one or more covers surrounding the base pipe and positioned about the FCD unit, the one or more covers forming a production fluid channel between the screen subassembly and the FCD unit, wherein the one or more separate isolated activation channels are positioned between the base pipe and the one more covers surrounding the base pipe.

2. The FCD module according to claim 1, wherein the one or more covers are removable.

3. The FCD module according to claim 1, wherein the one or more separate isolated activation channels are disposed exteriorly about the base pipe.

4. The FCD module according to claim 1, further including a diverter ring positioned about the base pipe, the diverter ring configured to physically and fluidly couple the FCD module to the screen subassembly.

5. The FCD module according to claim 4, wherein the diverter ring includes one or more ring hydraulic activation channels which are configured to fluidly couple the one or more separate isolated activation channels and the one or more hydraulic activation chambers of the screen subassembly.

6. The FCD module according to claim 4, wherein the diverter ring includes one or more ring production fluid channels which are configured to fluidly couple production fluid from the formation with the production fluid channel of the FCD module.

7. A sand control screen assembly, comprising:

a screen subassembly, including:

a blank pipe section;

one or more hydraulic activation chambers disposed exteriorly of the blank pipe section; and a filter medium disposed about the one or more hydraulic activation chambers for receiving production fluid from an oil and gas formation; and an FCD module fluidly coupled to the screen subassembly, the FCD module including;

a base pipe having a port coupling an exterior of the base pipe and an interior of the base pipe;

an FCD unit coupled to the base pipe about the port and configured to control production fluid from the oil and gas formation to the interior of the base pipe;

one or more separate isolated activation channels extending along at least a portion of the base pipe, the one or more separate isolated activation channels fluidly coupled with the one or more hydraulic activation chambers of the screen subassembly; and one or more covers surrounding the base pipe and positioned about the FCD unit and forming a production fluid channel between the filter medium and the FCD unit, wherein the one or more separate isolated activation channels are positioned between the base pipe and the one more covers surrounding the base pipe.

8. The sand control screen assembly according to claim 7, wherein the one or more hydraulic activation chambers are bladders.

9. The sand control screen assembly according to claim 7, wherein the one or more covers are removable.

10. The sand control screen assembly according to claim 7, further comprising a diverter ring coupled about the base pipe between the FCD unit and the screen subassembly.

11. The sand control screen assembly according to claim 10, wherein the diverter ring includes one or more ring hydraulic activation channels which fluidly couple the one or more separate isolated activation channels and the one or more hydraulic activation chambers.

12. The sand control screen assembly according to claim 10, wherein the diverter ring includes one or more ring production fluid channels which fluidly couple production fluid from the formation with the production fluid channel of the FCD module.

13. The sand control screen assembly according to claim 10, wherein the diverter ring is coupled with the FCD module by a threaded connection.

14. A well system, comprising:

a wellbore;

production tubing extending from a surface of the wellbore; and a sand control screen assembly coupled to the production tubing, the sand control screen assembly including:

a blank pipe section;

one or more hydraulic activation chambers disposed exteriorly of the blank pipe section; and a filter medium disposed about the one or more hydraulic activation chambers for receiving production fluid from an oil and gas formation; and an FCD module fluidly coupled to the screen assembly, the FCD module including;

a base pipe having a port coupling an exterior of the base pipe and an interior of the base pipe;

an FCD unit coupled to the base pipe about the port and configured to control production fluid from the oil and gas formation to the interior of the base pipe;

one or more separate isolated activation channels extending along at least a portion of the base pipe, the one or more separate isolated activation channels fluidly coupled with the one or more hydraulic activation chambers; and one or more covers surrounding the base pipe and positioned about the FCD unit and forming a production fluid channel between the filter medium and the FCD unit, wherein the one or more separate isolated activation channels are positioned between the base pipe and the one more covers surrounding the base pipe.

15. The well system according to claim 14, wherein the one or more hydraulic activation chambers are bladders.

16. The well system according to claim 14, wherein the one or more covers are removable.

17. The well system according to claim 14, further comprising a diverter ring coupled between the FCD unit and the screen subassembly, wherein the diverter ring includes:

one or more ring hydraulic activation channels which fluidly couple the one or more separate isolated activation channels and the one or more hydraulic activation chambers; and one or more ring production fluid channels which fluidly couple production fluid from the formation with the production fluid channel of the FCD module.

* * * * *